United States Patent [19]

Utsumi et al.

[11] Patent Number: 5,002,847

[45] Date of Patent: Mar. 26, 1991

[54] PROCESS OF PRODUCING ELECTROPHOTOGRAPHIC TONERS COMPRISES ULTRASONIC MIXING AND SUSPENSION POLYMERIZATION

[75] Inventors: Hiroshi Utsumi; Kinji Shinzo; Kazuya Kuriyama; Ryouzo Sugawara, all of Chiba; Masanobu Fukuda, Osaka, all of Japan; Shunichi Hiraishi, Fort Dlee, N.J.

[73] Assignee: Dainippon Ink and Chemicals, Inc., Tokyo, Japan

[21] Appl. No.: 402,405

[22] Filed: Sep. 5, 1989

Related U.S. Application Data

[63] Continuation of Ser. No. 081,218, Aug. 4, 1987, abandoned.

[30] Foreign Application Priority Data

| | | | |
|---|---|---|---|
| Aug. 4, 1986 | [JP] | Japan | 61-181925 |
| Aug. 4, 1986 | [JP] | Japan | 61-181926 |
| Aug. 13, 1986 | [JP] | Japan | 61-190057 |
| Mar. 19, 1987 | [JP] | Japan | 62-64966 |

[51] Int. Cl.[5] ..... G03G 50/00

[52] U.S. Cl. ..... 430/137; 204/157.42; 526/88; 526/909; 525/934

[58] Field of Search ..... 430/137; 204/157.42; 526/88, 909

[56] References Cited

U.S. PATENT DOCUMENTS

| | | | |
|---|---|---|---|
| 2,899,414 | 8/1959 | Mertes | 526/88 |
| 4,017,670 | 4/1977 | Spicuzza | 526/88 X |
| 4,231,919 | 11/1980 | Isaacson | 430/137 |
| 4,849,318 | 7/1989 | Tsubota | 524/904 X |

*Primary Examiner*—David Welsh

*Attorney, Agent, or Firm*—Armstrong, Nikaido, Marmelstein, Kubovcik & Murray

[57] ABSTRACT

A toner for developing electrostatic images and a process for producing the same is disclosed. The process comprises after applying ultrasonic waves to raw materials-mixture comprising addition polymerizable monomer(s), coloring agent(s) and water as indispensable components in the course of charging the raw materials-mixture into a reaction vessel or to a raw materials-mixture in a reaction vessel, at an application amount of from 0.05 to 50 W/l/hr. per unit treating volume and time using an ultrasonic homogenizer having frequencies of from 10 kHz to 50 kHz, subjecting the raw materials-mixture to suspension polymerization.

17 Claims, No Drawings

PROCESS OF PRODUCING ELECTROPHOTOGRAPHIC TONERS COMPRISES ULTRASONIC MIXING AND SUSPENSION POLYMERIZATION

This is a continuation of application Ser. No. 081,218 filed Aug. 4, 1987.

FIELD OF THE INVENTION

This invention relates to a process of producing electrostatic image developing toners which are used for an electrophotographic process, an electrostatic recording process, an electrostatic printing process, etc.

BACKGROUND OF THE INVENTION

Hitherto, a toner for developing electrostatic images is produced by kneading under melting a mixture of a pigment such as carbon black, phthalocyanine blue, Carmine 6B, benzidine yellow, magnetite, etc., with a binder resin, after cooling, grinding the kneaded mixture, and classifying them into powders having sizes of from 5 to 25 μm. For imparting necessary characteristics to toners, various additives are, if necessary, incorporated in the toners. For example, for controlling the level of the amount of triboelectricity generated at mixing toner and carrier, metal complex dyes, etc., are used. Also, for preventing papers from winding round a heat roll at fixing or the occurence of offset of paper at fixing, wax, etc., is added to toner at kneading under melting raw materials.

Also, since the form of toner is generally irregular and angular, a toner is usually poor in fluidity as powder. For improving the fluidity of toner powder, it has been frequently performed to dry-blend fine silica powders having primary particle size of from 10 μm to 100 m with toner. A magnetic toner containing magnetic substance such as magnetitite, etc., in the toner particles is directly and magnetically attached to a development sleeve covering a magnet roll to form magnet brush. On the other hand, a non-magnetic toner, i.e., a toner containing no magnetic substance is mixed with magnetic substance particles of from 30 μm to 200 μm in particle size, called as "carrier", to form magnetic brush.

The resolutsion power of developed images, the density of solid black portions, and a gradation reproducibility greatly depend upon the characteristics of toner and carrier, in particular, the particle sizes thereof and smaller particle sizes give images having higher image quality. Recent high-image copying machines frequently employ carriers of small particle size. The particle size of commercially available ordinary toners is from 10 μm to 12 μm in volume average particle size but the use of a toner having the average particle size of about 8 μm clearly improves image quality. It may be considered that the use of a toner having far smaller particle sizes can expect images of far higher image quality but when such a toner is actually prepared and used, it has been clarified that there are following problems.

(1) As the particle size of toner is smaller, the powder fluidity thereof becomes poorer. If the fluidity of toner is reduced, the toner forms bridges on a toner hopper to give hindrance for the supply of toner as well as the smoothness of the head of magnetic brush is reduced to form "haze" in images formed. In this case, the addition of a large amount of a fine hydrophobic silica powder as a fluidity improving agent may, as a matter of course, improve the fluidity of the toner but there occur troubles that the stability of the amount of tribo-charge is reduced and life of the developer is shortened.

(2) As the particle size of toner is smaller, the surface area thereof becomes larger and hence it is caused by the hygroscopicity of dyes or pigments exposed on the surface of the toner that the amount of tribo-charge is reduced and scattering of toner and the formation of fog are liable to occur at high humidity state.

(3) There is a limit in the dispersion of a dye or pigment for a resin and hence as the particle size of toner is smaller, very fine particles of uncovered carbon black or dye partially exist in the toner and partially exist on the surface of the toner in the attached state thereto. It is very difficult to remove these very fine particles in a classification step of toner and hence the existence is liable to appear as fog of images.

In view of the above-described problems in conventional techniques, the inventors have investigated for discovering a process of producing fine colored polymer particles, which can be used as toner as they are without need of grinding, by suspension polymerization, that is, for discovering a process of producing a toner by suspension polymerization capable of providing toner particles having uniform spherical particle form without need of grinding step, said toner particles having improved fluidity and charging property, and giving improved image quality. As the result of the investigations, the inventors have succeeded in achieving the present invention as set forth hereinbelow.

SUMMARY OF THE INVENTION

According to an embodiment of this invention, there is provided a process of producing a toner for developing electrostatic images, which comprises after applying ultrasonic waves to a raw materials-mixture comprising addition polymerizable monomer(s), coloring agent(s) and water as indispensable components in a course of charging the raw materials mixture into the reaction vessel or to a raw materials-mixture in the reaction vessel, at an application amount of from 0.05 to 50 w/l/hr. per unit treating volume and time using an ultrasonic homogenizer having frequencies of from 10 kHz to 50 kHz, subjecting the raw material mixture to suspension polymerization.

According to other embodiment of this invention, there is provided the aforesaid process of producing a toner, for developing electrostatic images, wherein ultrasonic waves are continuously or intermittently applied to the raw materials-mixture during polymerization using the ultrasonic homogenizer disposed in the reaction vessel, whereby the suspension polymerization is performed with an aggregation preventing effect.

According to a further embodiment of this invention, there is provided the aforesaid process of producing a toner for developing electrostatic images, wherein the raw materials-mixture which is dispersed by ultrasonic waves further contain suspension stabilizers.

According to a still further embodiment of this invention, there is provided the aforesaid process of producing a toner for developing electrostatic images, wherein as the suspension stabilizer, a mixture of an inorganic suspension stabilier and an organic suspension stabilizer in an amount of from 0.1 to 20 parts by weight per 100 parts by weight of the inorganic suspension stabilier or lithium phosphate is used.

According to other embodiment of this invention, there is provided the aforesaid process of producing a toner for developing electrostatic images, wherein the raw material 5-mixture contains dissolved therein from 1 to 70% by weight a polymer having a weight average molecular weight of from 600 to 500,000 capable of being dissolved in the addition polymerizable monomer(s).

According to another embodiment of this invention, there is further provided the aforesaid process of producing a toner for developing electrostatic images, wherein the raw material 5-mixture further contains a crosslinking monomer having at least two ethylenically unsaturated bonds in one molecule in an amount of from 0.5 to 2% by weight to the amount of the addition polymerizable monomer(s).

According to still another embodiment of this invention, there is further provided the process of producing a toner for developing electrostatic images, which comprises suspending a raw materials-mixture comprising addition polymerizable monomer(s), coloring agent(s) and water as indispensable components by using a high-pressure homogenizer for the raw materials-mixture in the course of charging the mixture into a reaction vessel and polymerizing in the reaction vessel.

Also, according to a still other embodiment of this invention, there is provided a toner for developing electrostatic images obtained by the above-described production process, wherein the form thereof is substantial sphere of from 0.95 to 1.00 in Wsdell's practical sphericity, the volume average particle size $D_v$ by a coulter counter method is from 7.0 μm to 25.0 μm, the number average particle size $D_n$ is from 5.0 μm to 25.0 μm, and at least 70% by weight of the whole particles are in the particle size range of from $D_V/\sqrt{2}$ to $\sqrt{2}D_V$ in volume particle size distribution.

Furthermore, according to further embodiment of this invention, there is also provided a toner for developing electrostatic images obtained by the above-described production process, wherein the form thereof is substantial sphere of from 0.9 to 1.00 in Wadell's practical sphericity, the volume average particle size $D_V$ by a coulter counter method is from 1.0 μm to 7.0 μm, the number average particle size $D_n$ is from 1.0 μm to 5.0 μm, and at least 70% by weight of the whole particles are in the particle size range of from $D_V/\sqrt{2}$ to $\sqrt{2}D_V$ in volume particle size distribution.

DETAILED EXPLANATION OF THE INVENTION

Then, the invention is explained in detail.

The addition polymerizable monomer which is used for the suspension polymerization in the process of this invention is a polymerizable unsaturated monomer having one ethylenically unsaturated bond in one molecule. Examples thereof are styrene and derivatives thereof such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, etc.; ethylenically unsaturated monoolefins such as ethylene, propylene, butylene, isobutylene, etc.; vinyl halides such as vinyl chloride, vinylidene chloride, vinyl bromide, vinyl fluoride, etc.; vinyl esters such as vinyl acetate, vinyl propionate, vinyl benzoate, etc.; methacrylic acid and α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate, etc.; acrylic acid and acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, phenyl acrylate, etc.; vinyl ethers such as vinyl methyl ether, vinyl ethyl ether, vinyl isobutyl ether, etc.; vinyl ketones such as vinyl methyl ketone, vinyl hexyl ketone, methyl isopropenyl ketone, etc.; N-vinyl compounds such as N-vinylpyrrole, N-vinylcarbazole, N-vinylindole, N-vinylpyrrolidone, etc.; acrylic acid derivatives or methacrylic acid derivatives such as acrylonitrile, methacrylonitrile, acrylamide, etc.; fumaric acid and fumaric acid mono- or di-alkyl esters such as, dimethyl fumarate, monobutyl fumarate, dibutyl fumarate, di-2-ethylhexyl fumarate, etc.; maleic acid, maleic anhydride, and maleic acid mon- or di-alkyl esters such as, dimethyl maleate, dibutyl melaeate, monobutyl maleate, etc.; and itaconic acid and itaconic acid alkyl esters such as methyl itaconate, ethyl itaconate, propyl itaconate, butyl itaconate, 2-ethylhexyl itaconate, etc. They may be used solely or as a combination thereof.

In addition, in the case of using the addition polymerizable monomer having a carboxy group, it is preferred to perform the polymerization using lithium phosphate (suspension stabilizer) described hereinafter.

In this invention, the suspension polymerization may be performed in the existence of a crosslinking monomer in the raw material mixture containing the addition polymerizable monomer(s) for the purpose of stabilizing suspended particles during the polymerization. The cross-linking monomer is a monomer having at least 2 ethylenically unsaturated bonds in one molecule and examples thereof are divinylbenzene, divinylnaphthalene, divinyl ether, divinylsulfone, diethylene glycol dimethacrylate, triethylene glycol dimethacrylate, ethylene glycol dimethacrylate, polyethylene glycol dimethacrylate, diethylene glycol diacrylate, triethylene glycol diacrylate, 1,3-butylene glycol dimethacrylate, 1,6-hexane glycol dimethacrylate, neopentyl glycol dimethacrylate, dipropylene glycol dimethacrylate, polypropylene glycol dimethacrylate, 2,2'-bis(4-methacryloxyethoxyphenyl)propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate, diallyl phthalate, etc.

In addition, in the case of using the crosslinking monomer, it is preferred that the amount thereof is from 0.5 to 2% by weight based on the amount of the addition polymerizable monomer from the points of fixing property, offset resistance, and durability.

To the aforesaid raw material mixture, a polymerization initiator is added and as the polymerization initiator, known polymerization initiators such as persulfates (e.g., potassium persulfate, etc.), azobisisobutyronitrile, benzoyl peroxide, methyl ethyl ketone peroxide, isopropyl peroxycarbonate, cumene hydroperoxide, 2,4-dichlorobenzoyl peroxide, lauroyl peroxide, etc., as well as redox type initiators, etc., can be used. The amount of the polymerization initiator is usually from about 0.1% to about 10% by weight, and preferably from 0.5% by weight to 5% by weight of the amount of the monomers.

Also, an ordianry molecular weight controlling agent can be used for the raw material mixture as an additive for controlling the molecular weight of a toner, which gives important influences on the thermal properties of the toner. Examples thereof are t-butylmercaptan, dodecylmercaptan, etc.

As coloring agents for use in this invention, there are pigments and dyes. Examples of pigments are balck pigments such as channel black, furnace balck, thermal black, acetylene black, etc., and colored pigments such as cadmium yellow, Hanza Yellow G, Naphthol Yellow S, Pyrazolone Red, Permanebt Red 4R, Mylybdenum Orange, Fast Violet B, Phthalocyanine Blue B, Fast Sky Blue, Phthalocyanine Green, Malachite Green, Naphthol Green B, etc. Examples of the dyes are C.I. Acid Red 1, C.I. Basic Red 1, C.I. Mordant Red 30, C.I. Direct Blue-1, C.I. Direct Blue-2, C.I. Acid Blue-9, C.I. Acid Blue-15, C.I. Basic Blue-3, C.I. Basic Blue-5, C.I. Mordant Blue-7, C.I. Direct Green-6, C.I. Basic Green 4, C.I. Basic Green 6, etc.

In this invention, it is preferred to add a suspension stabilizer to the aqueous phase. Examples of the suspension stabilizer are organic suspension stabilziers such as polyvinyl alcohol, gelatin, methyl cellulose, methylhydropropyl cellulose, ethyl cellulose, hydroxyethyl cellulose, a sodium salt of carboxymethyl cellulose, polyacrylic acid and salts thereof, starch, gum alginate, casein, etc., and inorganic suspension stabilizers such as lithium phosphate, tri-calcium phosphate, talc, barium sulfate, bentonite, aluminum hydroxide, ferric hydroxide, titanium hydroxide, calcium hydroxide, alumina, colloidal silica, etc. These suspension stabilizers can be used in the aqueous dispersion of the raw material mixture.

The suspension stabilizer is used in an amount of stabilizing the suspension in continuous phase, and preferably in the range of from about 0.1% by weight to about 50% by weight based on the total amount of the monomer.

As the suspension stabilizer for use in this invention, it is preferred to use the inorganic suspension stabilizer and the organic suspension stabilizer together, wherein the proportion of the organic suspension stabilzier is from 0.1 to 20 parts by weight to 100 parts by weight of the inorganic suspension stabilizer. If the proportion of the organic suspension stabilizer is less than 0.1 part by weight, toner particles formed are liable to become coarse and attach to the walls and shafts of the reaction vessel. Also, if the proportion thereof is over 20% by weight, extremely fine particles form and hence washing of the product becomes difficult.

Also, lithium phosphate is preferably used as the suspension stabilizer in this invention. In the case of using lithium phosphate, particles having volume average particle size of from 9.5 μm to 100 μm are liable to be obtained, the suspension stabilizer can be easily removed from the suspension polymerized product, and the suspension polymerization can be stably performed.

There is no restriction on the process of producing such lithium phosphate. For example, lithium phosphate is obtained by the reaction of phosphoric acid and lithium hydroxide. Lithium phosphate which can be used as the suspension stabilizer in this invention is obtained by the reaction of, generally, 1 mol of phosphoric acid and 1 mol to 3 mols of lithium hydroxide, and preferably 1 mol of phosphoric acid and 1.5 mols to 3 mols of lithium hydroxide. If the amount of lithium oxide is less than 1 mol, the water-insoluble salt is not usually obtained and even if the water-insoluble salt is obtained, the salt shows insufficient effect for stabilizing the suspension polymerization.

In addition, the amount of lithium phosphate is usually from 0.001% by weight to 20% by weight based on the amount of the addition polymerizable monomer.

The raw material mixture containing the addition polymerizable monomer may further contain a polymer having a weight average molecular weight of from 600 to 500,000 capable of being dissolved in the addition polymerizable monomer in an amount of from 1% by weight to 70% by weight based on the total amount of the monomer. The use of such a polymer is preferred in this invention since by the use of such a polymer, the practically sharp paricle size distribution and average particle size of toner particles produced can be desirably selected.

As the aforesaid polymer having weight average molecular weight of from 600 to 500,000, and preferably from 1,000 to 300,000, there are homopolymers and copolymers of the above-described polymerizable monomers. That is, there are homopolymers such as polystyrene, polyacrylic acid, polyacrylic acid esters, polymethacyrlic acid, polymethacrylic acid esters, polybutadiene, polyvinyl chloride, polyvinyl acetate, polyacrylamide, polyacrylonitrile, etc.; copolymers such as styrene copolymers, acrylic acid copolymers, methacyrlic acid copolymers, styrene-acrylic acid esters, styrene-methacyrlic acid esters, vinyl chloride-vinyl acetate, etc.; ternary or quaternary copolymers such as styrene-acrylic acid estermethacyrlic acid ester copolymers, styrene-acrylic acid ester-dibutyl fumarate copolymers, etc. Furthermore, there are ethyl cellulsoe, nitrocellulose, cellulose acetate butyrate, rosin, rosin oxide, and esters of them and at least partially hydrogenated esters of them, saturated and unsaturated polyester resins, carboxy group—containing saturated and unsaturated polyester resins, alkyd resins, epoxy resins, urethane resins, phenol resins, urea resins, melamine resins, gunamine resins (e.g., benzoguanamine), xylene resins, indene resins, petroleum resins, silicone resins, butyral resins, etc., which can be dissolved in the aforesaid polymerizable monomer.

As described above, there is no restriction on the kind of the polymer which is dissolved in the polymerizable monomer but since if the molecular weight thereof is too small, toner particles formed become poor in heat aggregation resistance, while if the molecular weight thereof is too large, the formation of fine particles by dispersion by the action of an ultrasonic homogenizer is hindered, the polymer having a weight average molecular weight of from 600 to 500,000 is preferred.

Also, the amount of the polymer to be dissolved in the polymerizable monomer is from 1% by weight to 70% by weight to the amount of the mixture thereof with the monomer. If the amount is too small, the control of the particle size of toner becomes insufficient, while if the amount is too large, fine particles which can be used as toner cannot be obtained. In addition, in the polymers described above, the polymer having an acid group, preferably a carboxylic acid group can remakably as stabilized by lithium phosphate as a suspension stabilizer when used together with the suspension stabilizer.

Moreover, in this invention, a surface active agent may be used as an auxiliary dispersing agent for the aforesaid suspension stabilizer in the range of from 0.001% by weight to 0.1% by weight based on the In addition, the dispersion of the polymerizable monomer, coloring agent, etc., may be performed by the application of ultrasonic waves after pre-dispersing them in water by means of a conventional stirrer or (homo)mixer, or may be directly performed by one try by the ultrasonic homogenizer. A polymerization initiator, a crosslinking agent and other additives may be dispersed together with water, subjectted to the treatment with ultrasonic homogenizer, or directly supplied to the reaction vessel for the polymerization. Also, monomers which are afterward to the reaction vessel during the polymerization reaction are preferably added thereto after applying thereto an ultrasonic homogenizer treatment in the existence of a suspension stabilizer and water. Also, for further stabilizing the suspension in the reaction vessel, the suspension may be circulated between the reaction vessel and an ultrasonic homogenizer during the polymerization reaction to prevent the aggregation of polymer by the application of ultrasonic waves. In addition, by the method, toner particles having sharper particle size distribution can be obtained. After the reaction is over, toner particles formed are washed, collected by a suitable method such as filtration, decantation, centrifigal separation, etc., and dried.

In the process of this invention, toner (A) in which the form thereof is substantial sphere of from 0.95 to 1.00 in Wadell's practical sphericity, the volume average particle size $D_V$ by a coulter counter method is from 1.0 μm to 7.0 μm, preferably from 3.0 μm to 7.0 μm, the number average particle size $D_n$ is from 1.0 μm to 5.0 μm, preferably from 2.0 μm to 5.0 μm, and at least 70% by weight of the whole particles are in the particle size range of from $D_v/\sqrt{2}$ to $\sqrt{2}D_v$ in volume particle size distribution or toner (B) in which the form is substantial sphere of from 0.95 to 1.00 μm in Wadell's practical sphericity, the volume average particle size $D_v$ is from 7.0 μm to 25.0 μm, preferably from 7 μm to 14 μm, the number average particle size $D_n$ is from 5.0 μm to 25.0 μm, preferably from 5 μm to 10 μm, and at least 70% by weight of the whole particles are in the particle size range of $D_v/\sqrt{2}$ to $\sqrt{2}D_v$ in volume particle size distribution can be obtained by suitably selecting the conditions.

Now, the Wadell's practical sphericity is a value by the ratio or the diameter of the circe having the area same as the projected area of a particle to the diameter of the smallest circe which is in contact with the periphery of the projected image of the particle.

Practically, a bit of toner particles is dispersed on a slide glass so that the particles are not contact with each other or not piled upon each other. These toner particles are projected on CRT at 500 magnification by a Ruzex 450 (trade name, made by Nippon Regulator K.K.). In this case, since Ruzex 450 can select optionally each particle if the particles as disposed separately from each other and the projected area can be measured, whereby the diamter of a circle having the same area as the projected area can be calculated. On the other hand, the CRT image is photographed as it is and the diameter of the smallest circle which is in contact with the perphery of the projected image of particle is determined by drawing. In this invention, calculation was made on 100 toner particles selected at random above and the average value of them was used as "Wadell's practical sphericity".

In addition, when the dispersion condition in the course of the suspension polymerization or the selection of the suspension stabilizer is inadequate, it sometimes happens that rice grain-form or form of circle stone, which is so-called "special queen form beads" form and when such specific form beads form in large quantities to reduce the Wadell's practical sphericity below 0.95, it frequently happens that the fluidity of the toner particles is reduced to reduce the image quality and cleaning property.

Also, by selecting the volume average particle size and the number average particle size of toner particles in the ranges defined in this invention as described above, images having high resolving power and high image quality are obtained or neither fog nor haze occurs even in the case of high speed development owing to the excellent fluidity of the toner particles.

Furthermore, when the volume particle size distribution of toner particles is in the range defined in this invention as described above, the resolving power and image quality of images formed are more improved or the fluidity of the toner particles is more improved.

Then, the production processes of above-described toner (A) and toner (B) are explained.

First, materials to be contained in toner, such as dye or pigment, wax, etc., are dissolved or dispersed in an addition polymerizable monomer to provide "raw material mixture". The dispersion of the aforesaid materials may be performed by using a ball mill, an attritor, a vibration mill, a colloid mill, etc., which is used for general solid-liquid dispersion but is properly perfomred by using, in particular, an ultrasonic homogenizer. An ultrasonic homogenizer is suitable for the dispersion of a solid-liquid dispersion system of relatively low viscosity and has a power of dispersing well dyes, pigments, etc., which are reluctant to be wetted with oily phase. On the other hand, when a dispersing means having low dispersing faculity, such as a homomixer, etc., is used, fine particles of bare or uncovered dyes or pigments partially exist in toner particles and partially attach to the surface of the toner particles, which causes the formation of fog.

Then, the raw material mixture thus prepared is dispersed in water. In this case, it is known to produce spherical toner by a suspension polymerization using a TK homomixer of high shering power as a dispersing means but such a dispersing means is unsuitable for attaining the object of this invention. That is, by the dispersion using a TK homomixer, it is impossible to obtained a toner having a sharp particle size distribution as in this invention. On the other hand, in the case of using an ultrasonic homogenizer or a high-pressure homogenizer, an astonishingly excellent effect is obtained and toner particles having a volume average particle size of from 1 μm to 7 μm and a sharp particle size distribution of from 1.0 m to 7.0 μm (toner A) or from 7.0 μm to 25.0 μm (toner B) can be, easily obtained.

In an ultrasonic homogenizer, by converting an electric power from a commercial electric source of 50 or 60 cycles into en electric power of 10 to 250 kHz, coverting the electric power into an oscillation power of the same frequency, transmitting the oscillation power to a radiator (horn) while amplifying the amplitude of the oscillation, and applying the ultrasonic waves into the dispersion from the radiator, a large power can be locally concentrated to disperse fine particles. In this case, the particle sizes of the dispersed particles tend to be finer as the frequency of the ultrasonic oscillation is higher and for obtaining the toner particle sizes of this invention, the frequency of from 10 kHz to 50 kHz is adequate. If the frequency is over 50 kHz, extremely fine dispersed particles form to provide an emulsion like state, which results in reducing the polymerization yield.

Furthermore, as a manner of using an ultrasonic homogenizer, it may be possible to apply ultrasonic waves by equipping the radiator (horn) to the inside of a reaction vessel for performing the suspension polymerization but the use of an ultrasonic homogenizer of a structure having 2 or more cells each containing an ultrasonic radiator (horn) through which the raw materials-mixture passes successively, whereby the mixture is allied with ultrasonic waves, is advantageous in energy efficiency and is suitable for attaining the object of this invention.

In addition, toner A and toner B are different in the application amount of ultrasonic waves to "raw materials-mixture". That is, toner A is obtained by increasing the application amount of ultrasonic waves or, practically, lowering the flow rate of "raw materials-mixture" to be applied with ultrasonic waves, while toner B is obtained by increasing the flow rate of "raw materials-mixture" to reduce the application amount of ultrasonic waves.

A high-pressure homogenizer was invented by a Frenchman, August Gaulin and performs the dispersion of fine particles by cavitations formed in liquid as in an ultrasonic homogenizer. An ultrasonic homogenizer form caviations by electric driving method, while a pressure homogenizer form cavitations by a mechanical method as described below to perform fine particle dispersion.

Such a homogenizer is composed of a pressing mechanism for increasing the pressure of a liquid to be treated to a definite high-pressure and a homovalve mechanism of giving a homogenizing effect. As the pressing mechanism, a volume-type pump (plunger) is used since the accuracy for quantity is high and a pressure can be optionally set. On the other hand, the homovalve mechanism is composed of a valve, a valve sheet, and an impact ring. The valve is equipped facing the valve sheet and attached under pressure to the sheet by means of a spring or by oil pressure.

A liquid to be treated pressed by the pump wrench opens a gap between the valve and the sheet and passes through the gap. The opening of the gap can be optionally set by the tension pressure of the aforesaid spring or oil pressure. The pressure applied to the liquid at passing through the gap is suddenly reduced to the vapor pressure of the liquid, whereby the flow rate reaches at once a sound velocity range. In this case, it is considered that cavitations (cavity phenomenon) are caused in the liquid, then the cavities are filled with saturated steam to recover pressure, and a kind of shock wave occurs to tear particles in the dispersion phase. The high-pressure homogenization is, at present, mainly explained by the aforesaid cavitation theory.

In this case, the pressure applied to a liquid to be treated can be controlled by selecting the opening of the gap between the valve and the sheet. The pressure applied is from 100 to 1000 kg/cm$^2$, and preferably from 100 to 600 kg/cm$^2$. As the pressure is higher, the particle size of toner particles formed becomes smaller.

The high-pressure homogenizer may be disposed at the course of supplying raw materials-mixture to a reaction vessel or may be disposed to a circulation roop disposed outside the reaction vessel to perform continuously or intermittently the high-pressure homogenizer treatment during the polymerization reaction as the case of the ultrasonic homogneizer.

For preventing re-aggregation of dispersed pigment(s) at the production of the polymerizable mixture, a suitable amount of a resin or a dispersion aid may be added to the mixture. Also, it is suitable that the ratio of the polymerizable mixture to water is fron 1:2 to 1:10.

In the case of equipping the radiator (horn) inside of a reaction vessel, the polymerization may be performed without the addition of a suspension stabilizer but usually a suspension stabilizer is used. When a suspension stabilizer is added to the system, the suspension of fine particles once subjected to the ultrasonic treatment or high-pressure homogenizer treatment is reluctant to cause aggregation of particles if mild paddle stirring is continuously applied. This is an phenomenon which has never been obtained in the case of using a homomixer.

Then, the invention is further explained in detail by the following examples. In addition, parts in the examples and comparison examples shown below are by weight.

EXAMPLE 1

While stirring well 80 parts of styrene, 3 parts of butyl acrylate, 7 parts of methyl methacrylate, 1 part of bivinylbenzene, 5 parts of Elftex 8 (carbon black, trade name, made by Cabot Corporation), 4 parts of Biscol 550P (polypropylene wax, trade name, made by Sanyo Kasei Industries, Ltd.), 2 parts of Bontron S-34 (charge controlling agent, trade name, made by Orient Kagaku K.K.), 2 parts of azobisisobutyronitrile, and 1 part of dodecylmercaptan in a beaker, they were dispersed by means of ultrasonic homogenizer RUS-600 (600 Watt, frequency 20 kHz), made by Nippon Seiki K.K. Apart from this, 500 parts of ion-exchanged water was charged in other vessel equipped with paddle type stirring blades and after adding thereto the aforesaid polymerizable mixture, they were dispersed and suspended. While applying thereto using the aforesaid homogenizer under the condition of 3.3 W/l/hr., the raw materials-mixture was charged in a reaction vessel equipped with paddle type stirring blades. The inside atmosphere of the reaction vessel was replaced with nitrogen and after immediately rasing the temperature of the system to 80° C., the polymerization was performed. Then, the polymerization was finished after 5 hours by an ordinary means for confirming the end point of suspension polymerization. Thereafter, by filtrating and drying toner formed, a raw powder of toner was obtained. The volume average particle size of the toner obtained was about 5 μm and the number average particle size thereof was above 4 μm. The toner contained 70% by volume of particles of from 3 μm to 7 μm and hence a classifying procedure was unnecessary. The Wadell's practical sphericity of the toner obtained was 0.98.

By mixing 30 parts of the toner with 1,000 parts of iron powder carrier EFV 200/300, made in Nippon Teppun K.K., a developer was prepared and the charging amount of the toner measured by using a blow-off charging amount measuring apparatus was −38 μc./gr. When the developer was subjected to a development test using a copying machine, Reodry 3504, made by Toshiba Corporation, image having very good resilving power, gradation, and density at solid balck portion and having no haze and fog were obtained. Also, the charging amount of the toner was −36 μc./gr. even under high humidity condition of 35° C. and 85% RH and image quality formed was not changed under such condition. Furthermore, as the result of continuous copying test of 10,000 copies, the cleaning property was good and the image quality was scarecely changed.

EXAMPLE 2

While stirring well 80 parts of styrene, 13 parts of butyl acrylate, 7 parts of methyl methacrylate, 1 part of divinylbenzene, 5 parts of Erftex 8 (carbon black, trade name, made by Cabot Corporation), 4 parts of Biscoal 550P (polypropylene wax, trade name, made by Sanyo Kasei Industries, Ltd.), 2 parts of Bontron S-34 (charge controlling agent, trade name, made by Orient Kagaku K. K.), 2 parts of azobisisobutyronitrile, and 1 part of dodecylmercaptan in a beaker, they were dispersed therein by means of an ultrasonic homogenizer RUS-600 (600 W, frequency 20 kHz), made by Nippon Seiki K. K. Apart from this, 500 parts of ion-exchanged water was placed on a separate vessel equipped with paddle type stirring blades and the aforesaid polymerizable mixture was added thereto and suspended by dispersion. While applying ultrasonic waves to the suspension under flow rate of 3 liters/min. using the aforesaid homogenizer under the condition of 3.3 W/l/hr., the suspension was supplied to a reaction vessel equipped with ultrasonic homogenizer having a faculty of 5 W/liter to the volume of the vessel and paddle type sirring blades. The inside atmosphere of the reaction vessel was replaced with nitrogen and after immediately raising the temperature of the system to 80° C., the polymerization was performed. Also, for keeping the dispersion state in the reaction system every 30 minutes, ultrasonic waves were applied thereto for 10 minutes each. The polymerization was finished after about 5 hours by an ordianry means for confirming the end point of suspension polymerization. Thereafter, by filtrating and drying toner formed, a raw powder of toner was obtained. The volume average particle size of the toner obtained was about 5 μm and the number average particle size thereof was about 4 μm. The toner formed contained 80% by volume of particles of 3 μm to 7 μm in particle size and hence a classifying procedure was unnecessary. The Wadel's practical sphericity of the toner obtained was 0.98.

By mixing 30 parts of the toner with 1,000 parts of iron powder carrier EFV 200/300, made by Nippon Seifun K. K., a developer was prepared and when the developer was subjected to development test using a ocpying macine, Reodry 3504, made by Toshiba Corporation, images having very good resolving power, gradation, and density at solid black portion and having no haze and fog were obtained. Also, the charging amount of the toner was −33 μc/gr. even under high humidity condition of 35° C. and 85% RH and also the image quality was not changed under the conditions. Furthermore, as the result of performing continuous copying test of 10,000 copies, the cleaning porperty was good and the image quality was scarecely changed.

EXAMPLE 3

While stirring well 52 parts of styrene, 8 parts of 2-ethylhexyl methacrylate, 1 part of ethylene glycol dimethacrylate, 40 parts of Magnetite BL-500 (made by Titan Kogyo K. K.), 4 parts of Biscoal 550P (polypropylene wax, trade name, made by Sanyo Kasei Industries, Ltd.), 2 parts of Bontron D-34 (charge controlling agent, trade name, made by Orient Kagaku K. K.), and 2 parts of azobisisobutyronitrile in a beaker, they were dispersed by means of an ultrasonic homogenizer RUS-600 (600 W, frequency 20 kHz), made by Nippon Seiki K. K. Apart from this, 500 parts of ion-exchanged water, 30 parts of colloidal silica, Aerosil 200 (trade name, made by Nippon Aerosil K. K.), and 2 parts of hydroxyethyl cellulose AG-15 (made by Fuji Chemical Co.) were charged in a vessel equipped with paddle type stirring blades followd by dispersing with stirring and then the aforesaid polymerizable mixture was added thereto and suspended by dispersion. While subjecting again the suspension to ultrasonic treatment at flow rate of 3 liters/min. using the aforesaid homogenizer under the condition of 3.3 W/l/hr., the suspension was charged in a reaction vessel equipped with puddle type stirrong blades. The inside atmosphere of the reaction vessel was replaced with nitrogen and after immediately raising the temperature thereof to 80° C., the polymerization was performed. The polymerization was finished after 5 hours by an ordinary means for confirming the end point of suspension polymerization. After cooling the reaction product to room temperature, dewatering and washing were repeatedly applied to the product, the proeuct was dried to provide a raw powder of toner. The volume average particle size of the toner obtained was about 6 μm and the number average particle size thereof was 4.6 μm. The toner contained 73% by volume of particles having particle sizes of from 4 μm to 8 μm and a classifying procedure was unnecessary. The Wadell's practical sphericity was 0.97. When copying was performed by means of a copying machine NP-400RE, made by Canon Inc., using the toner, clear smages having very excellent resolving power and having no haze and fog were obtained.

COMPARISON EXAMPLE 1

In a reaction vessel were charged 80 parts of styrene, 13 parts of butyl acrylate, 7 parts of methyl methacrylate, 1 part of divinylbenzene, 2 parts of azobisisobutyronitrile, 1 part of dodecylmercaptan, 2 parts of calcium phosphate, and 500 parts of water and suspension polymerization was performed by ordinary method to provide a copolymer. Then, 100 parts of the copolymer thus obtained was melt-kneaded together with 4 parts of Biscoal 550P, 2 parts of Bontron S=34, and 7 parts of Erftex-8 for 40 minutes by a press kneader and after cooling, the kneaded mixture was ground by a jet mill. By classifying procedure, amorphous comparison toner A having a volume average particle size of about 10 μm, wherein particles having the particle size range of from 8 μm to 12 μm was 65%, and amorphous comparison toner B having a volume average particle size of about 5.5 μm, wherein particles having the particle size range of from 3.5 μm to 7.5 μm was 78% by volume, were obtained.

COMPARISON EXAMPLE 2

A polymerizable mixture having the same composition as in Example 1 dispersed by stirring well in a bleaker was prepared. Apart from this, 2 parts of calcium phosphate and 500 parts of ion-exchanged water were charged in a reaction vessel equipped with a TK homomixer (made by Tokushu Kogyo K. K. and they were dispersed at 4,000 rpm. Then, the above-described polymerizable mixture was suspended by dispersion in the dispersion in the reaction vessel. While blowing nitrogen gas in the mixture, the temperature thereof was raised to 80° C. and the mixture was stirred for 30 minutes at 4,000 rpm. Thereafter, the mixture was further stirred by ordinary padde stirring blades and the reaction was completed after about 5 hours. Then, by post-treating the reaction mixture as in Example 1, a toner having broad particle size distribution, i.e., having a volume average particle size of 13 μm and a number average particle size of 4 μm was obtained. By classifying procedure, toner C having volume average particle size of 13.5 μm and toner D having volume average particle size of 5.8 μm were obtained.

The characteristics and the development test resutls of toners A, B, C, and D obtained above-described Examples 1 and 2 and Comparison Examples 1 and 2 are shown in Table 1 below.

TABLE 1

| | Example 1 | Example 2 | Comparison Example 1 | | Comparison Example 2 | |
|---|---|---|---|---|---|---|
| | | | Toner A | Toner B | toner C | Toner D |
| Volume Average Particle Size (μm) | 5 | 5 | 10 | 5.5 | 13.5 | 5.8 |
| Volume Distribution of 3-7 μm (%) | 70 | 80 | 65 | 78 | 73 | 64 |
| Form | Sphere (Wadel 0.98) | Sphere (Wadel 0.98) | Amorphous | Amorphous | Sphere (Wadel 0.96) | Sphere (Wadel 0.98) |
| The Amount of Tribo-charge (μc./gr) | −38 | −35 | −21 | −40 | −23 | −43 |
| Resolving Power (line/mm) | 10 | 10 | 4 | 7 | 3 | 9 |
| Gradation | 8 | 9 | 4 | 7 | 4 | 7 |
| Uniformity of Solid Black Portion | ○ | ○ | Δ | X | Δ | Δ |
| Haze | ○ | ○ | ○ | X | ○ | Δ |
| Toner Scattering | ○ | ○ | ○ | X | ○ | X |
| Fog | ○ | ○ | ○ | X | ○ | X |
| Total Evaluation | ◎ | ◎ | Δ | X | Δ | X |

Evaluation in Table
◎ Very good
○ Good
Δ Fairly bad
X Bad

| Example 3 | |
|---|---|
| Styrene | 800 parts |
| Butyl Acrylate | 200 parts |
| Erftex 8 (carbon black, trade name, made by Cabot Corp.) | 70 parts |
| Biscoal 550P (polypropylene wax, trade name, made by Sanyo Kasei Industries, Ltd.) | 40 parts |
| Bontron S-34 (charge controlling agent, trade name, made by Orient Kagaku K.K.) | 20 parts |
| Divnylbenzene | 10 parts |
| Azobisisobutyronitrile | 20 parts |

Three cells of ultrasonic homogenizer US-600 (600 W, 20 kHz) made by Nippon Seiki K. K. were connected each other in series and the mixture of the above-described raw materials was passed therethrough at a flow speed of 500 ml/min. while subjecting thereto dispersion treatment to provide a polymerizable mixture. Apart from this, 20 parts of a fine powder of calcium phopshate and 1 part of Poval PA-05 (polyvinyl alcohol, trade name, made by Sin-Etsu Chemical Co., Ltd.) were dispersed in 5,000 parts of water with stirring and the aforesad polymerizable mixture was added to the dispersion with stirring. Then, while applying suspension treatment for forming fine particles to the resultant mixture at a flow rate of 1,000 ml/min. using the above-described 3 cell-type ultrasonic homogenizer, the mixture was charged in a reaction vessel the inside atmosphere of which had been replaced with nitrogen. Thereafter, the mixture was stirred by ordinary means for 10 hours at 70° C. to finish the reaction. After cooling the reaction mixture to room temperature, hydrochloric acid was added thereto until the pH thereof became 2 to decompose calcium phosphate, and after repeating dewatering and washing, the product was dried to provide a toner. The volume acerage particle size of the toner obtained was 5.3 μm and the number average particle size thereof was 4.5 μm. The toner obtained contained 77% by weight particles having a volume particle size distribution of from $D_v/\sqrt{2}$ to $\sqrt{2}D_v$, that is, from 3.7 μm to 7.5 μm and hence any classifying procedure was unnecessary. The Wadell's practical sphericity was 0.98.

By mixing 30 parts of the toner with 1,000 parts of iron powder carrier EFV 200/300, made by Nippon Teppun K. K., a developer was prepared. The charging amount of the toner measured by a blow off charging amount measuring device was −38 μc/gr. When the development was subjected to a development test using a copying machine Reodry 3504, trade name, made by Toshiba Corporation, high-quality images having very good resolving power, gradation and density at solid black portion and having no haze and fog were obtained. Also, the charging amount was −36 μc/gr. even under high humidity condition of 35° C., 85% RH and the image quality of images formed was not changed under the aforesaid condition. Furthermore, as the results of continuous copying test of 10,000 copies, the cleaning property was good and image quality was scarecely changed.

EXAMPLE 4

The polymerizable mixture obtained by the same manner as in Example 1 was treated at a speed of 1.1 liter/min. using a pressure homogenizer H-10 (pressure 150 kg/cm$^2$), made by Nippon Seiki K. K. in place of the ultrasonic homogenizer and thereafter the mixture was treated as in

| Comparison Example 3 | |
|---|---|
| Styrene | 800 parts |
| Butyl Acrylate | 200 parts |
| Divinylbenzene | 10 parts |
| Dodecylmercaptan | 10 parts |
| Azobisisobutyronitrile | 20 parts |
| Calcium phosphate | 20 parts |
| Water | 5,000 parts |

The above raw materials were mixed with stirring by an ordinary stirrer and the subjected to suspension polymerization to provide a polymer.

Then, 1,000 parts of the polymer thus obtained was kneaded with 40 parts of Biscoal 550P, 20 parts of Bontron S-34, and 70 parts of Erftex 8 for 40 minutes by means of a press kneader and after cooling, the kneaded mixture was ground by a jet mill. By classifying procefure, amorphous comparison toner E having a volume average particle size of 10.0 μm and containing 65% by weight particles having a volume particle size distribution of the range of from $D_v/\sqrt{2}$ to $\sqrt{2}D_v$ and amorphous comparison toner F having a volume average particle size of 5.5 μm and containing 78% by weight particles of the range of $D_v/\sqrt{2}$ to $\sqrt{2}D_v$ were obtained.

COMAPRISON EXAMPLE 4

A polymerizable mixture obtained by the same manner as in Example 1 was placed in a reaction vessel equipped with a TK homomixer (made by Tokushu Kogyo K. K.) and then 20 parts of calcium phosphate and 5,000 parts of water were added, as dispersion, to the mixture with stirring. Then, while blowing nitrogen into the reaction vessel, the temperature of the system was raised to 70° C. and the mixture was stirred for 30 minutes at 4,000 r.p.m. Thereafter, the mixture was stirred for 10 hours by ordianry paddle stirring blades to perform reaction. A toner having a volume average particle size of 13.0 μm, a number average particle size of 4.1 μm, and a broad particle size distribution was obtained. By classifying procedure, comparison toner G having a volume average particle size of 13.5 μm and comparison toner H having a volume average particle size or 5.8 μm were obtained.

The characteristics and development test results of the toners of this invention obtained in Examples 3 and 4 and comparison toners E, F, G, and H are shown in Table 2 below.

-continued

| Example 5 | |
|---|---|
| Azobisisobutyronitrile | 20 parts |

While stirring well the mixture of the aforesaid components, the mixture was subjected to dispersion treatment by passing through an ultrasonic homogenizer US-600 (600 W, 20 kHz) made by Nippon Seiki K. K. having three cells connected in series at a flow rate of 500 ml/min. to provide a polymerizable mixture. Apart from this, 30 parts of Aerosil 200 (colloidal silica, trade name, made by Nippon Aerosil K. K.) and 2 parts of hydroxyethyl cellulose AG-15 made by Fuji Chemical K. K. were dispersed in 5,000 parts of water with stirring and the aforesaid polymerizable mixture was added to the dispersion. While stirring the resultant mixture, the mixture was subjected to a suspension treatment for forming fine particles by passing through the above-described three cell-type ultrasonic homogenizer at a flow rate of 1,000 ml/min. and charged in a reaction vessel the inside atmosphere of which had been replaced with nitrogen. Then, the mixture was further stirred by an ordinary means for 10 hours at 70° C. to finish the reaction. After cooling the reaction mixture, the mixture was repetedly subjected to dewatering and washing and dried to provide a toner. The volume average particle size of the toner obtaiend was 6.0 μm and the number average particle size thereof was 4.6 μm. The toner contained 73% by weight particles having a volume particle size distribution in the range of $D_v/\sqrt{2}$ to $\sqrt{2}D_v$ and hence a classifying procedure was unnecessary. The Wadell's practical sphericity was 0.97.

TABLE 2

| | Toner of Example 3 | Toner of Example 4 | Comparison Example 3 Toner E | Comparison Example 3 Toner F | Comparison Example 4 Toner G | Comparison Example 4 Toner H |
|---|---|---|---|---|---|---|
| Volume Average Particle Size $D_v$ (μm) | 5.3 | 6.2 | 10.0 | 5.5 | 13.5 | 5.8 |
| Number Average Particle Size $D_n$ (μm) | 4.5 | 4.9 | 6.8 | 4.8 | 8.9 | 3.0 |
| Volume Particle Size Distribution Weight of $\frac{D_v}{\sqrt{2}} \sim \sqrt{2}\ D_v$ | 77 | 75 | 65 | 78 | 73 | 64 |
| Form | Sphere | Sphere | Amorphous | Amorphous | Sphere | Sphere |
| (Wadel's Practical Sphericity) | (0.98) | (0.97) | | | (0.96) | (0.98) |
| Charging Amount (μc/gr) | −38 | −35 | −21 | −40 | −23 | −43 |
| Resolving Power (lines/mm) | ◎ (10) | ◎ (9) | Δ (4) | ○ (7) | Δ (3) | ○ (9) |
| Gradation (Gradation No.) | ○ (8) | ○ (8) | Δ (4) | ○ (7) | Δ (4) | ○ (7) |
| Uniformity in Solid State Parture | ○ | ○ | Δ | X | Δ | Δ |
| Haze | ○ | ○ | ○ | X | ○ | Δ |
| Toner Scattering | ○ | ○ | ○ | X | ○ | X |
| Fay | ○ | ○ | ○ | X | ○ | X |
| Cleaning Property | ○ | ○ | Δ | X | Δ | Δ |
| Total Evaluation | ◎ | ◎ | Δ | X | Δ | X |

Evaluation: ◎ Very good ○ Good Δ Fairly bad X Bad

| Example 5 | |
|---|---|
| Styrene | 520 parts |
| 2-Ethylhexyl Methacrylate | 80 parts |
| BL-500 (magnetite, trade name, made by Titan Kogyo K.K.) | 400 parts |
| Biscoal 550P (polypropylene wax, trade name, made by Sanyo Kasei Industries, Ltd.) | 40 parts |
| Bontron S-34 (charge controlling agent, Orient Kagaku K.K.) | 20 parts |
| Ethylene Glycol Dimethacrylate | 10 parts |

When copying test was performed by means of a copying machine NP-400RE, made by Canon Inc., using the toner thus obtained, clear images having very excellent resolving power and having no haze and fog were obtained.

| Example 6 | |
|---|---|
| Styene | 800 parts |
| Butyl Acrylate | 200 parts |
| Erftex 8 (carbon black, trade name, made by Cabot Co.) | 70 parts |

-continued

| Example 6 | |
|---|---|
| Biscoal 550P (polypropylene wax, trade name, made by Sanyo Kasei Industries, Ltd.) | 40 parts |
| Bontron S-34 (charge controlling agent, made by Orient Kagaku K.K.) | 20 parts |
| Divinylbenzene | 10 parts |
| Azobisisobutyronitrile | 20 parts |

While stirring well the aforesaid raw materials, the raw material mixture was subjected to a dispersion treatment by passing three an ultrasonic homogenizer US-300 (300 W, 20 kHz) having three cells connected in series at a flow rate of 500 ml/min. to provide a polymerizable mixture. Apart from this, 10 parts of a fine powder of calcium phosphate and 0.5 part of Poval PA-05 (polyvinyl alcohol, trade name, made by Shin-Etsu Chemical Co., Ltd.) were dispersed in 5,000 parts of water with stirring and the aforesaid polymerizable mixture was added to the dispersion. While stirring the resultant mixture, the mixture was subjected a suspension treatment for forming fine particles by passing through the aforesaid tree cell-type ultrasonic homogenizer at a flow rate of 3,000 ml/min. and charged in a reaction vessel the inside atmosphere of which had been replaced with nitrogen. The mixture was further stirred by an ordianry manner for 10 hours at 70° C. to finish the reaction. After cooling the reaction mixture to room temperature, hydrochloric acid was added thereto until the pH thereof became 2 to decompose calcium phosphate and then the product was repeatedly subjected to dewatering and washing, and dried to provide a toner. The volum average particle size of the toner obtained was 11.0 m and the number average particle size thereof was 9.9 m. The toner contained 72% particles having a volume particle size distribution in the range of $D_v/2$ to $2D_v$, i.e., in the range of from 7.8 μm to 15.6 μm and hence a classifying procedure was unnecessary. The Wadell's practical sphericity thereof was 0.98.

By mixing 40 parts of the toner thus obtained with 1,000 parts of ferrite carrier TFC-38, made by TDK Corporation, a developer was prepared and when the charging amount of the toner was measured using a blow off charging amount measuring device, the charging amount was −27 μc/gr.

When the developer was subjected to development test using a copying machine Reodry 8801, made by Toshiba Corporation, high quality images having very good resolving power, gradation and density at solid black portions and having no haze and fog were obtained. Also, the charging amount was −26 μc/gr. even under high humidity condition of 35° C. and 85% RH and image quality was not changed under the aforesaid condition. Furthermore, as the results of continuous copying test of 10,000 copies, it was confirmed that the cleaning property was good and the iamge quality of images formed scarecely changed.

EXAMPLE 7

A polymerizable mixture obtained by the same manner as in Example 6 was subjected to a suspension treatment using a pressure homogenizer H-10 (pressure 150 kg/cm$^2$) in place of the ultrasonic homogenizer at a flow rate of 3.3 liters/min. and thereafter was terated by the same step in Example 6 to provide a toner.

| Comparison Example 5 | |
|---|---|
| Styrene | 800 parts |
| Butyl Acrylate | 200 parts |
| Divinylbenzene | 10 parts |
| Dodecylmercaptan | 10 parts |
| Azobisisobutyronitrile | 20 parts |
| Calcium Phosphate | 20 parts |
| Water | 5,000 parts |

The aforesaid raw materials were mixed with stirring by a simple stirrer and the subjected to suspension polymerization to provide a polymer.

Then, 1,000 parts of the polymer thus obtained was mixed with 40 parts of Biscoal 550P, 20 parts of Bontron S-34, and 70 parts of Erftex-8, the mixture was kneaded for 40 minutes by means of a press kneader, and after cooling, the kneaded mixture was gound by a jet mill. By classifying procedure, comparison toner I having a volume average particle size of 10.7 μm and containing 60% by weight particles having a volume particle distribution in the range of $D_v\sqrt{2}$ to $\sqrt{2}D_v$ was obtained.

COMAPRISON EXAMPLE 6

A polymerizable mixture obtained by the same manner as in Example 1 was placed in a reaction vessel equipped with TK homomixer (made by Tokushu Kogyo K.K.) and a dispersion of 20 parts of calcium phosphate in 5,000 parts of water, was added thereto with stirring at 4,000 r.p.m. While blowing nitrogen gas into the reaction vessel, the temperature of the system was raised to 70° C. and the mixture was stirred for 30 minutes at 4,000 r.p.m. Thereafter, the reaction was performed for 10 hours by stirring with ordinary paddle stirring blades. Thus, toner particles having a volume average particle size of 13.0 μm and number average particle size of 4.1 μm and having broad particle size distribution were obtained. By classifying procedure, comprison toner J having a volume average particle size of 13.5 mm was obtained. The characteristics and the development test results of the toners in Examples 6 and 7 and comparison toners I and J are shown in Table 3 below.

TABLE 3

| | Toner of Example 6 | Toner of Example 7 | Comparison Example 5 Toner I | Comparison Example 6 Toner J |
|---|---|---|---|---|
| Volume Average Particle Size $D_v$ (μm) | 11.0 | 10.7 | 10.7 | 13.5 |
| Number Average Particle Size $D_n$ (μm) | 9.9 | 9.6 | 7.3 | 8.9 |
| Volume Particle Size Distribution | | | | |
| Weight of $\frac{D_v}{\sqrt{2}} \sim \sqrt{2}\ D_v$ | 72 | 75 | 60 | 73 |
| Form | Sphere | Sphere | Amorphous | Sphere |
| (Wadel's Practical Sphoricity) | (0.98) | (0.97) | | (0.96) |
| Charging Amount (μc/gr) | −27 | −25 | −28 | −23 |
| Resolving Power (lines/mm) | ○ | ○ | Δ | Δ |

TABLE 3-continued

| | Toner of Example 6 | Toner of Example 7 | Comparison Example 5 Toner I | Comparison Example 6 Toner J |
|---|---|---|---|---|
| | (7) | (7) | (4) | (4) |
| Gradation | O | O | Δ | Δ |
| (Gradation No.) | (6) | (6) | (4) | (4) |
| Uniformity in Solid State Parture | O | O | Δ | Δ |
| Haze | O | O | Δ | Δ |
| Toner Scattering | O | O | Δ | Δ |
| Fog | O | O | Δ | Δ |
| Cleaning Property | O | O | Δ | Δ |
| Total Evaluation | ⊙ | ⊙ | Δ | Δ |

Evaluation: ⊙ Very good O Good Δ Fairly bad X Bad

| Example 8 | |
|---|---|
| Styrene | 520 parts |
| 2-Ethylhexyl Methacrylate | 80 parts |
| BL-500 (magnetite, trade name, mady by Titan Kogyo K.K.) | 400 parts |
| Biscoal 550P (polypropylene wax, trade name, made by Sanyo Kasei Industries, Ltd ) | 40 parts |
| Bontron S-34 (charging controlling agent, trade name, made by Orient Kagaku K.K.) | 20 parts |
| Ethylene Glycol Dimethacrylate | 10 parts |
| Azobisisobutyronitrile | 20 parts |

While stirring well, the aforesaid raw materials were subjected to a dispersion treatment by passing through an ultrasonic homogenizer US-300 (300 W, 20 kHz) having three cells connected in series, made by Nippon Seiki K.K., and a flow rate of 500 ml/min. to provide a polymerizable mixture. Apart from this, 10 parts of Aerosil 200 (colloidal silica, trade name, made by Nippon Aerosil K.K.) and 1 part of hydroxyethyl cellulose AG-15, made by Fuji Chemical K.K. were dispersed in 5,000 parts of water with stirring and then the aforesaid polymerizable mixture was added to the dispersion. While stirring, the resultant mixture was subjected to suspension treatment for forming fine particles by passing through the aforesaid three cell-type ultrasonic homogenizer at a flow rate of 3,000 ml/min. and charged in a reaction vessel the inside atmosphere of which had been replaced with nitrogen gas. Then, the mixture was stirred by an ordianry stirring means for 10 hours at 70° C. to finish the reaction. After cooling to room temperature, the reaction mixture was repeatedly subjected to dewatering and washing and dried to provide a toner. The volume average particle size of the toner obtained was 11.2 μm and the number average particle size thereof was 10.1 μm. The toner contained 73% by weight particles having a volume particle size distribution in the range of $D_v/2$ to $2D_v$ and hence classifying procedure was unnecessary. The Wadell's practical sphericity was 0.97. When copying test was performed by a copying machine NP-500RE, made by Canon Corporation using the toner, clear images having excellent resolving power and having no haze and fog were obtained.

SYNTHESIS EXAMPLE 1

In a flask equipped with a thermometer, a stirring rod, and a nitrogen inlet were placed 160 parts of styrene, 26 parts of n-butyl acrylate, 16 parts of MMA, 300 parts of ion-exchanged water, 2 parts of benzoyl peroxide, and 2 parts of Poval PA-05 (made by Shin-Etsu Chemical Co., Ltd.) and suspension polymerization was performed for 15 hours at 90° C. under nitrogen stream. A pearl like product obtained was washed with water and dried. The weight average molecular weight of the polymer obtained was $1.3\times10^5$.

SYNTHESIS EXAMPLE 2

By following the same procedure as Synthesis Example 1 except that 0.1 part of benzyl peroxide was added in place of adding 2 parts thereof, a resin was synthesized. The weight average molecular weight of the polymer obtained was $3\times10^5$.

SYNTHESIS EXAMPLE 3

In a five neck flask equipped with a thermometer, a stirring rod, and a nitrogen inlet was placed 200 parts of xylene, the temperature thereof was raised to 130° C. under nitrogen stream, and a uniform dissolved mixture of 170 parts by styrene, 30 parts of n-butyl acrylate, and 14 parts of benzoyl peroxide was added dropwise to the flask over a period of 2 hours. Thereafter, a polymerization was performed for 20 hours and the product was heated to 200° C. at reduced pressure of 5 mmHg to distill off xylene. The weight average molecular weight of the polymer obtained was $7\times10^3$.

SYNTHESIS EXAMPLE 4

In a four neck glass flask equipped with a thermometer, a stirring rod, and a nitrogen inlet were placed 740 parts of polyoxypropylene(2.2 mols)-2,2-bis(4-hydroxyphenyl)propane, 230 parts of terephthalic acid, and 4 parts of tetrabutyl thitanate and the mixture was heated by an electric heating mantle under nitrogen stream to perform reaction at 220° C. until the acid value became 15 KOH mg/g. The weight average molecular weight of the polyester resin obtained was 6,000.

EXAMPLE 9

While stirring well 70 parts of styrene, 10 parts of butyl acrylate, 20 parts of methyl methacrylate, 1 part of divinylbenzene, 5 parts of Erftex 8 (carbon black, trade name, made by Cabot Co.), 4 parts of Biscoal 550P (polyporpylene wax, trade name, made by Sanyo Kasei Co., Ltd.), 2 parts of Bontrol S-34 (charge controlling agent, trade name, made by Orient Kagaku K.K.), 1 part of dodecylmercaptan, and 10 parts of the polymer obtained in Synthesis Example 1 in a beaker, they were dispersed by an ultrosonic homogenizer (600 W, 14.5 kHz). Apart from this, 500 parts of ion-exchange water was placed in a vessel equipped with paddle type stirring blades and the above-described polymerizable mixture was suspended therein. While applying thereto ultrasonic treatment at a flow rate of 3 liters/min, the suspension was charged in a reaction vessel equipped with padde type stirring blades and after immmediately raising the temperature thereof to 80° C., they were stirred for 5 hours to perform polymerization. Then, the polymerized product was filtered and dried to provide a toner powder. The volume average particle size of the toner obtained was 6 μm and the number average particle size thereof was 4.1 μm. The toner contained 80% by weight particles having particle sizes of 4 μm to 8 μm and had a sharp particle size distribution. By the same manner as Comaprison Example 2 using the toner, a developer was prepared and when a development test was performed using the developer, high quality images having very good resolving power, gradation and density of solid black portions and having no haze and fog were obtained. Also, the image quality was not changed under high humidity condition of 35° C., 85% RH. Also, as the result of continuous copying test of 10,000 copies, the cleaning property was good and the image quality of images scarecely changed.

EXAMPLE 10

By following the same procedure as Example 9 except that 15 parts of the polymer obtained in Synthesis Example 1 was added, a toner was produced. The volume average particle size of the toner obtained was 10 μm and the numbre average particle size thereof was 9.2 μm. The toner contained 75% by weight particles having particle sizes of 8 μm to 12 μm and had a sharp particle size distribution. Also, as the result of tesing the toner as in Example 6, same good results as in Example 6 were obtained.

EXAMPLE 11

By following the same procedure as Example 9 except that 30 parts of the polymer obtained in Synthesis Example 3, a toner was produced. The volume average particle size of the toner obtained was 11.5 μm and the number average particle size thereof was 10.4 μm. The toner contained 76% by weight particles having particle sizes of 9.5 μm to 13.5 μm and had a sharp particle size distribution. Also, as the result of testing the toner as in Example 9, the results were good and also offset property was good.

EXAMPLE 12

By following the same procedure as Example 1 except that 3 parts of the polymer obtained in Synthesis Example 2 was added in place of 10 parts of the polymer obtained in Synthesis Example 1, the toner aomponents mixture was pre-dispersed in 500 g of ion-exchanged water by paddle type stirring blades, and then the mixture was subjected to ultrasonic treatment by an ultrasonic homogenizer (600 W, 20 kHz) at a flow rate of 3 liters/min., a toner was produced. The volume average particle size of the toner obtained was 11 μm and the number average particle size thereof was 10.2 μm. The toner obtained contained 74% by weight particles having particle sizes of 9 μm to 12 μm and had a sharp particle size distribution. Also, when the toner was subjected to a same test as in Example 9, good results were obtained.

EXAMPLE 13

By following the same procedure as Example 12 except that 40 parts of the polymer obtained in Synthesis Example 4 was added in place of the polymer obtained in Synthesis Example 2, a toner was produced. The volume average particle size of the toner obtained was 12 μm and the number average particle size thereof was 11.2 μm. The toner obtained contained 76% by weight particles having particle sizes of 10 μm to 14 μm and had a sharp particle size distribution. Also, as the result of testing the toner as in Example 9, the offset property and fixing property were good.

SYNTHESIS EXAMPLE 5

In 1,960 parts of water was dissolved 98 parts of phosphoric acid and while stirring the solution in a 5 liter glass vessel equipped with a stirrer, an aqueous solution of 48 parts of lithium hydroxide dissolved in 960 parts of water was added gradually to the solution. As the result thereof, an aqueous suspension containing 5% fine white pigments, lithium phosphate ($Li_2HPO_4$) was obtained.

EXAMPLE 14

While stirring well 800 parts of styrene, 200 parts of n-butyl acrylate, 60 parts of Erftex 8 (carbon black, trade name, made by Cabot Co.), 40 parts of Biscoal 550P (polyporpylene wax, trade name, made by Sanyo Kasei Co., Ltd.), 20 parts of Bontron S-34 (charge controlling agent, trade name, made by Orient Kagaku K.K.), 10 parts of divinylbenzene, and 20 parts of azobisisobutyronitrile, they were subjected to dispersion treatment by passing through an ultrasonic homogenizer having three cells connected in series, made by Nippon Seiki K.K. at a flow rate of 500 ml/min. to provide a dispersion of polymerizable mixture. Then, 100 parts of the aqueous suspension of lithium phosphate obtained in Syhthesis Example 5 described above was dispersed in 4,800 parts of water with stirring and the aforesaid dispersion of polymerizable mixture was added to the dispersion. While stirring the mixture, the mixture was suspended for forming fine particles by passing through the aforesaid three cell type ultrasonic homogenizer at a flow rate of 3,000 ml/min. and changed in a reaction vessel the inside atmosphere of whic had been replaced with nitrogen gas. Then, the mixture was stirred by an ordinary stirring means for 10 hours at 70° C. to finish the reaction. After cooling the reaction mixture to rom temperature, hydrochloric acid was added until the pH became 5.5 to decompose lithium phosphate and the product was subjected to dehydration and washing, and then dried to provide a toner. The volume average particle size of the toner obtained was 9 μm and the number particle size thereof was 8.1 μm.

While the invention has been described in detail and with reference to specific embodiment thereof, it will be apparent to one skilled in the art that various changes and modifications can be made therein without departing from the spirit and scope thereof.

What is claimed is:

1. A process for producing a toner for developing electrostatic images comprising the steps of:

(a) preparing a polymerizable raw materials-mixture by dispersing, in an aqueous dispersion medium, a coloring agent in an addition polymerizable monomer;

(b) preparing a fine suspension of a colored oily substance by applying ultrasonic waves to the mixture formed in (a), at an application amount of 0.05–50 W/1/hr. per unit treating volume and time, using an ultrasonic homogenizer having frequencies of 10–50 KHz; and (c) subjecting the mixture to suspension polymerization.

2. The process of producing a toner for developing electrostatic images as claimed in claim 18, wherein ultrasonic waves are continuously or intermittently applied to the raw materials-mixture during polymerization using the ultrasonic homogenizer disposed in the reaction vessel, whereby the suspension polymerization is performed with an aggregation preventing effect.

3. The process of producing a toner for developing electrostatic images as claimed in claim 18, wherein when materials to be contained in toner are dissolved or dispersed in the addition polymerizable monomer, ultrasonic waves are applied to them.

4. The process of producing a toner for developing electrostatic images as claimed in claim 18, wherein the ultrasonic homogenizer generates ultrasonic waves having frequencies of from 10 kHz to 40 kHz and has 2 or more cells containing ultrasonic radiator (horn).

5. The process of producing a toner for developing electrostatic images as claimed in claim 18, wherein the raw material mixture contains a suspension stabilizer.

6. The process of producing a toner for developing electrostatic images as claimed in claim 5, wherein the suspension stabilizer comprises 100 parts by weight of an inorganic suspension stabilizer and 0.1 to 20 parts by weight of an organic suspension stabilizer.

7. The process of producing a toner for developing electrostatic images as claimed in claim 18, wherein the raw material mixture contains dissolved therein 1 to 70% by weight a polymer having weight average molecular weight of from 600 to 500,000 capable of being dissolved in the addition polymerizable monomer.

8. The process of claim 18 of producing a toner for developing electrostatic images, which comprises the raw material mixture contains a crosslinking monomer having at least 2 ethylenically unsaturated bonds in one molecule in the amount of from 0.5 to 2% by weight based on the amount of the addition polymerizable monomer.

9. The process of producing a toner for developing electrostatic images as claimed in claim 5, wherein the suspension stabilizer is lithium phosphate.

10. A process of producing a toner for developing electrostatic images as claimed in claim 18, wherein the raw material mixture contains lithium phosphate and a polymer having acid group.

11. A process of producing a toner for developing electrostatic images, which comprises suspending a raw materials-mixture comprising addition polymerizable monomer(s); coloring agent(s) and water as indispensable components by using a high pressure homogenizer for the raw materials-mixture in the course of charging the raw materials-mixture into a reaction vessel and polymerizing them in the reaction vessel.

12. A toner for developing electrostatic images, wherein the Wadell's practical sphericity is from 0.95 to 1.00, a volume average particle size $D_v$ by coulter counter method is from 7.0 μm to 25.0 μm, a number average particle size $D_n$ is from 5.0 μm to 25.0 μm, and at least 70% by weight of the whole particles have a volume particle size distribution in the particle size range of $D_v/\sqrt{2}$ to $\sqrt{2}D_v$.

13. The toner for developing electrostatic images as claimed in claim 12, wherein the volume average particle size $D_v$ is from 7.0 μm to 14.0 μm.

14. The toner for developing electrostatic images as claimed in claim 12, wherein the number average particle size $D_n$ is from 5.0 μm to 10.0 μm.

15. A toner for developing electrostatic images, wherein the Wadell's practical sphericity is from 0.95 to 10.0, a volume average particle size $D_v$ by coulter counter method is from 1.0 μm to 7.0 μm, a number average particle size $D_n$ is from 1.0 μm to 5.0 μm, and at least 70% by weight of the whole particles have a volume particle size distribution in the particle size range of from $D_v/\sqrt{2}$ to $\sqrt{2}D_v$.

16. The toner for developing electrostatic images as claimed in claim 15, wherein the volume average particle size $D_v$ is from 3.0 μm to 7.0 μm.

17. The toner for developing electrostatic images as claimed in claim 15, wherein the number average particle size $D_n$ is from 2.0 μm to 5.0 μm.

* * * * *